United States Patent [19]

Sartor

[11] Patent Number: 4,825,566

[45] Date of Patent: May 2, 1989

[54] SKI BOOT

[75] Inventor: Mariano Sartor, Montebelluna, Italy

[73] Assignee: Nordica S.p.A., Montebelluna, Italy

[21] Appl. No.: 132,846

[22] Filed: Dec. 14, 1987

[30] Foreign Application Priority Data

Dec. 23, 1986 [IT] Italy ..... 82596 A/86
Dec. 12, 1987 [IT] Italy ..... 82545 A/87

[51] Int. Cl.[4] ..... A43B 5/04

[52] U.S. Cl. ..... 36/117; 36/2 R; 36/119

[58] Field of Search ..... 36/117–121, 36/50, 87, 2 R

[56] References Cited

U.S. PATENT DOCUMENTS 3,750,310 8/1973 Messner et al. ..... 36/119 X
4,461,098 7/1984 Diegerman ..... 36/2 R
4,620,379 11/1986 Sartor ..... 36/119
4,713,895 12/1987 Vallieres ..... 36/2 R

FOREIGN PATENT DOCUMENTS 3429284 2/1986 Fed. Rep. of Germany ..... 36/119
3626476 2/1987 Fed. Rep. of Germany ..... 36/117
631632 8/1982 Switzerland ..... 36/117

*Primary Examiner*—James Kee Chi
*Attorney, Agent, or Firm*—Guido Modiano; Albert Josif

[57] ABSTRACT

The ski boot comprises a shell constituted by a rigid sole connected to an upper accommodating an inner shoe. One or more longitudinal slots are provided at the shell, arranged preferably laterally with respect to the upper, and a device for the securing and adjustment of one or more traction elements embracing the upper is furthermore associable. A covering element, having characteristics of waterproofing, thermal insulation and elastic deformability, is furthermore externally associable with the shell.

21 Claims, 4 Drawing Sheets

5
1
25
30
26
32
31
27
28
28
3

12
10
5
8a
9a
11
6
14
2
4
23
17
13
19
18
29
21
15
16
3

5
12
10
9b
8b
11
7
14
18
13
17
22
19
3
16
15
23

401
402
403
404
405
406
407
408
409
410
411
412
413
414
415
416
417
418
419
420
421
422
423
424
425
426
427
428
429
430
236
237a
238
240
241
242a
242b
243
202

SKI BOOT

BACKGROUND OF THE INVENTION

The present invention relates to a ski boot.

Known ski boots are currently mainly composed of a shell whereon there is articulated at least one quarter to allow the rotary movement thereof during the flexings and the extensions which can be performed by the skier while skiing.

Said quarters articulated to the shell allow, for example in rear-entry ski boots, the facilitated insertion of the foot.

Such known types of ski boots however have the disadvantage of being constituted by a considerable number of elements which must be molded individually and then coupled to one another.

As a partial solution to this disadvantage, structures of rear-entry ski boots are known, of the so-called monolithic type since they are constituted by a shell and by a front quarter provided enbloc, whereto a rear quarter is articulated.

A disadvantage can be found even in these known types of structure, due to their extreme rigidity.

As a partial solution to this disadvantage, in a U.S. Pat. No. 4,030,215 filed on 2.11.1974 a sports shoe is disclosed which is made of plastic material having a rigid upper end on which seats are provided at the region above the heel and the instep of the foot for inserts associated with an elastically deformable closure edge arrangeable at said upper end.

Even this known type of footwear has disadvantages: first of all, since the same is produced by means of a mold, difficulties in its extraction are apparent due to the practically indeformable structure and secondly the fact is made apparent that there is an insufficient rear support due to the presence of the abovementioned insert.

The shoe furthermore certainly entails difficulties for the skier in the step of the introduction therein of the foot.

The possibility furthermore exists of infiltrations of water at the seats for said front and rear inserts.

SUMMARY OF THE INVENTION

The aim of the present invention is therefore to eliminate the disadvantages described above in known types by providing a ski boot which allows the reduction of the number of components to be assembled and at the same time has an easy insertability.

Another important object is to provide a boot which allows the obtainment of a reduction in the costs of industrialization, having at the same time a good simplicity of assembly in production.

Another object is to provide a boot having a modest weight, said boot being structurally simple.

Within the scope of the above described aim, a further important object is to provide a boot comprising a shell obtainable by molding which is easily extractable from the mold.

Still another object is to obtain a ski boot which has aesthetical characteristics which are diversified from known boots.

Another object is to provide a boot having good comfort for the skier together with an optimum securing of the foot.

Still another object is to provide a boot having an optimum lateral and rear grip, allowing at the same time the forward flexing of the skier's leg.

This aim, as well as these and other objects which will become apparent hereinafter, are achieved by a ski boot structure comprising a monolithic shell including a substantially rigid sole and an upper, an integral inner shoe of the conventional soft type insertable in said shell, adjustable closure means to adjustably secure said shell to the skier's foot and lower leg, said upper having a top edge and at least one elongate aperture extending downwardly from said top edge, wherein said at least one aperture comprises one first pair of lateral slots proximate to the rear portion of the upper and a second pair of lateral slots proximate to the front portion of the upper, said slots extending longitudinally of said upper to end approximately at the height of the skier's ankle so as to define in said upper at least one rear flap and one front flap which can elastically swivel back and fro and are separated by a pair of lateral portions engaging the skier's malleoli, said closure means being arranged to at least partially embrace said front and rear flaps and said lateral portions of the upper, and wherein said ski boot structure further comprises an at least partially semi-rigid covering element which is removably associated with said upper to sealingly enclose said upper, whereby operation of said closure means causes width restriction of said slots thus determining substantially uniform and resilient tightening of the ski boot, and whereby said covering element provides both sealing of said slots against snow infiltration and enhanced rigidity of said upper.

BRIEF DESCRIPTION OF THE DRAWINGS

Further characteristics and advantages of the invention will become apparent from the detailed description of a particular, but not exclusive, embodiment, illustrated only by way of non-limitative example in the accompanying drawings, wherein.

DESCRIPTION OF THE PREFERRED EMBODIMENTS

Figures 1, 2, 3:
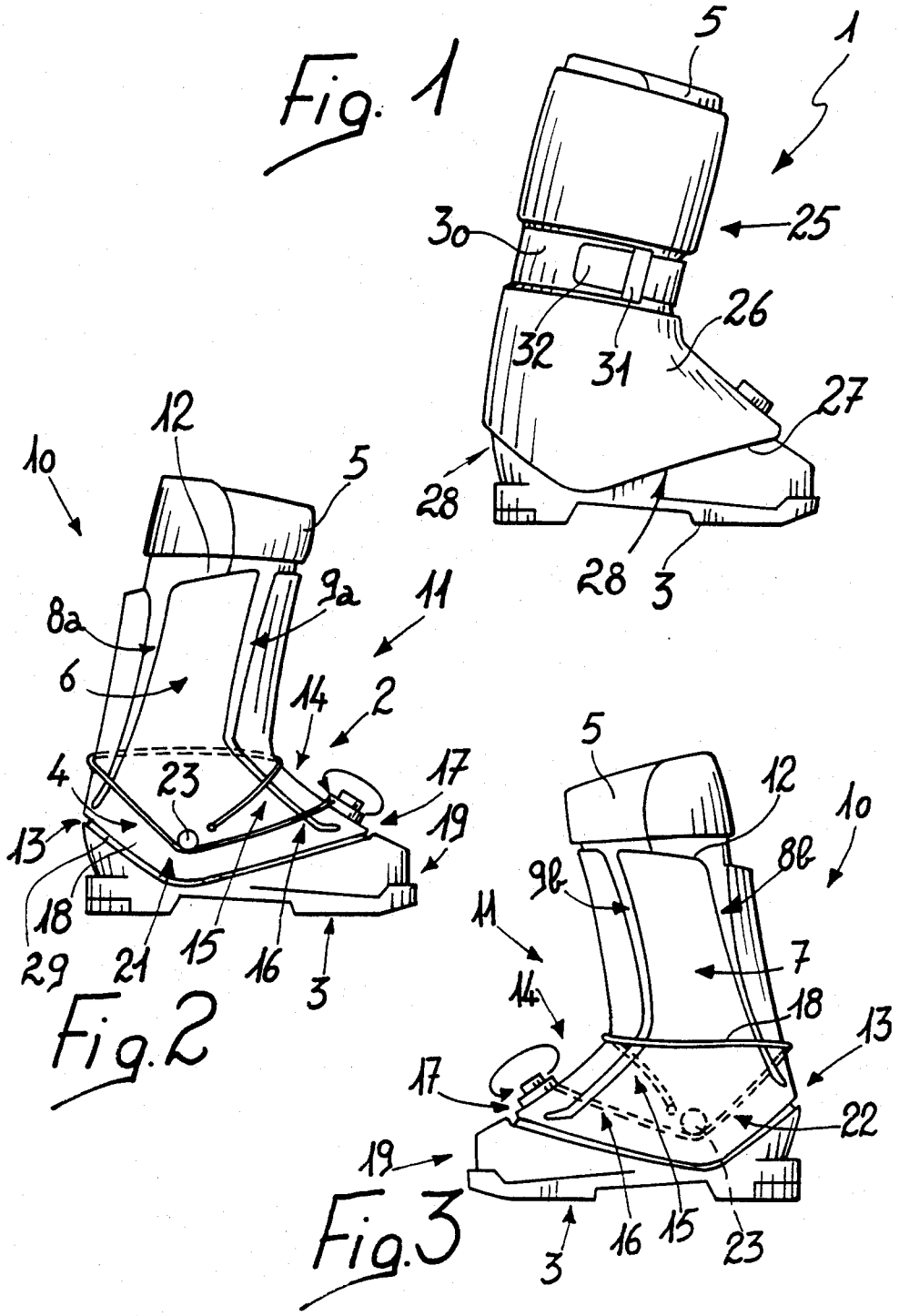
FIG. 1 is a lateral view of the ski boot.
FIG. 2 is a view, similar to the previous one, of the ski boot without the covering element.
FIG. 3 is another lateral view of the shell.

With reference to the above described figures, the ski boot 1 with simplified insertion of the foot comprises a shell 2 formed monolithically and composed of a rigid sole 3 connected to an upper 4, inside the shell 2 there being removably accommodatable an inner shoe 5.

The upper 4, besides embracing the foot, also completely embraces the lower part of the leg of the skier.

A first pair of longitudinal slots, indicated by the reference numerals 8*a* and 8*b*, and a second pair of longitudinal slots, indicated by the numerals 9*a* and 9*b*, are furthermore provided on the upper 4 at the lateral regions 6 and 7 overlying the regions of the malleoli of the foot.

Said first longitudinal pair of slots 8*a* and 8*b* and said second pair of longitudinal slots 9*a* and 9*b* are respectively specular with respect to the middle longitudinal and vertical plane of the shell 2..

The first pair of longitudinal slots 8*a* and 8*b* are furthermore provided proximate to the rear region 10 of the shell 2, the second pair of longitudinal slots 9*a* and 9*b* being instead adjacent to the front region 11 thereof.

The first pair of longitudinal slots 8*a* and 8*b* thus affect the upper 4 from the upper perimetral edge 12 thereof approximately up to the region overlying the heel region, indicated by the numeral 13.

The second pair of longitudinal slots 9*a* and 9*b* again start from the upper perimetral edge 12 of the upper 4 laterally affecting, however, the region 14 of the back of the foot, and in particular both the lateral region 15 of the tarsal bones and the lateral region 16 of the metatarsal bones.

The arrangement of said first and of said second pair of slots allows therefore the flexibility of the shell 2 during flexing and the insertion of the foot, the latter occurring centrally.

A tensioning device 17 for the securing and/or adjustment of at least one traction element 18, constituted for example by a cable, are furthermore associated with the shell 2.

Advantageously, the tensioning device 17 can be arranged at a region adjacent to the tip 19 of the shell, the latter possibly being of the winding type.

In order to allow an optimum securing of the foot and in particular in the regions of the instep and of the heel, the traction element 18 affects the shell 2 externally with a first loop, in particular the lateral regions 21 and 22 and then the rear region 10 and the back region 14, as illustrated in FIG. 2; its terminal end is rigidly associated with the shell while a guide element 23 is provided at the region 21.

Figure 4:
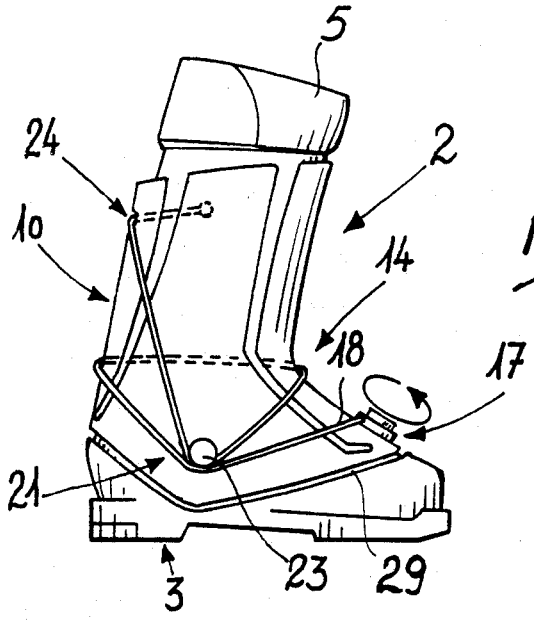
FIG. 4 is a lateral view of the boot of the preceding figures but with a different arrangement of the traction element.

As illustrated in FIG. 4, said traction element 18 can conveniently further affect, at the outer lateral region 21 of the shell 2, the guide element 23, again affecting with a second loop the rear region 10 of the shell, the same being guided within a seat 24 adjacent to the upper rear edge 12 of the upper 4, the terminal end of the fraction element 18 being subsequently fixed to the latter at the lateral region 22.

This solution allows an improved rear grip.

A covering element 25, constituted by a tubular member 26 in a waterproof material, thermally insulating and elasticized, is an essential component part of the ski boot 1.

Said tubular member 26 is provided, at the lower perimetral edge 27, with means for coupling to complementarily shaped grip means 28 provided at said shell 2.

Said grip means can be constituted, for example, by a groove 29 provided at the shell and embracing the latter.

Naturally the tubular member 26 has an adapted opening at the tensioning device 17.

Advantageously, with said tubular member 26 there is furthermore associated a device adapted to allow its securing, said device being for example constituted by a band 30 having at one end a buckel means 31 for the temporary engagement of the free end 32.

The use of the ski boot 1 is thus as follows: by virture of the upper insertion of the foot, it is sufficient for the skier to widen the upper edge of the inner shoe 5, elastically deformating both the shell 2 and the tubular member 26, in the first case said deformation being allowed by the presence of the of the first and second pair of longitudinal slots.

Once the foot is inserted, the skier acts at the securing and/or adjustment device 17, appropriately locking the foot inside the boot, and at the band 30, thus locking the leg.

The transverse rigidity of the boot is ensured by the lateral regions 6 and 7 of the shell 2 while the rear grip is provided by the mutual contact between the edges of the pair of first slots 8*a* and 8*b*.

Figure 5:
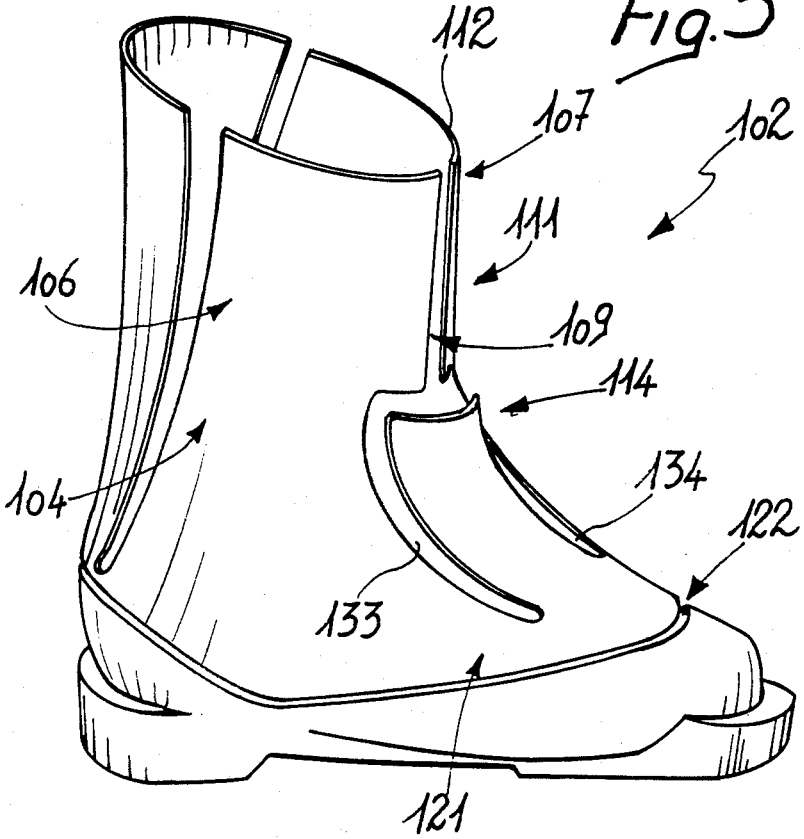
FIG. 5 is a perspective view of a boot according to another aspect of the invention.

FIG. 5 schematically illustrates a shell 102 of a boot according to another aspect of the invention. The shell 102 is provided, at the middle longitudinal plane, with a substantially longitudinal slot 109 provided at the front region 111 of said shell.

Said slot 109 starts from the upper perimetral edge 112 of the upper 104, bifurcating approximately at the region 114 of the instep of the foot into two parallel arms, indicated by the numerals 133 and 134 and respectively affecting the lateral regions 121 and 122 of the shell 102.

This embodiment allows an improved transverse rigidity by virtue of the fact that the lateral regions 106 and 107 embrace the leg to a greater extent.

Figures 6, 7, 9, 10, 11:
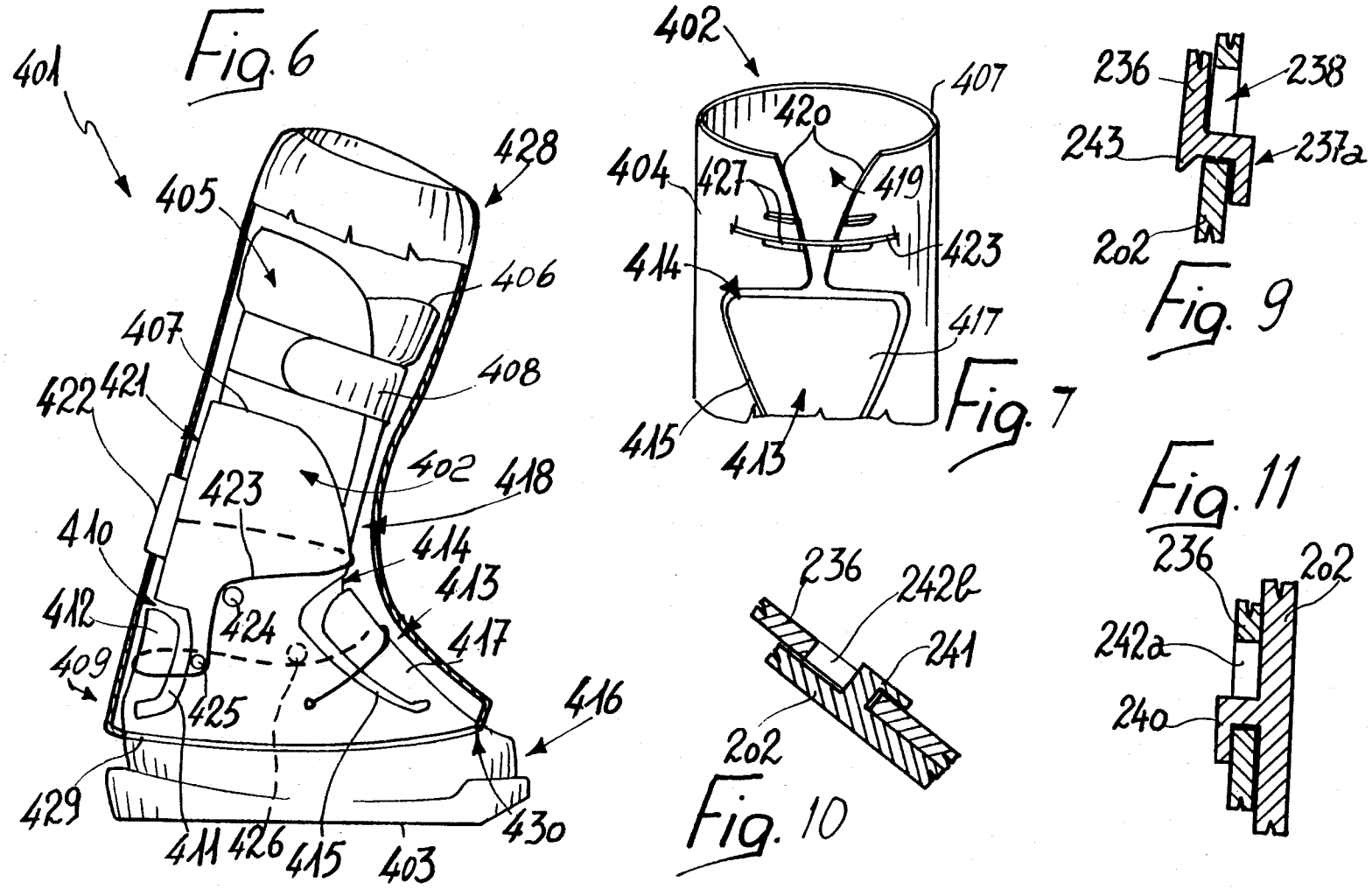
FIG. 6 is a lateral view, in partial cross section, of a boot according to yet another aspect of the invention.
FIG. 7 is a partial perspective view of the front part of the shell.
FIG. 9 is a cross section view along the line IX—IX of FIG. 8.
FIG. 10 is a cross section view of the front engagement point of the shell.
FIG. 11 is a cross section view of the rear engagement point.

With reference to FIGS. 6 and 7, a ski boot is illustrated, generally indicated by the reference numeral 401, according to yet another aspect of the invention and comprising a shell 402, formed monolithically and composed of a rigid sole 403 whereto an upper 404 is connected.

A removable inner shoe 405 is furthermore accommodated inside the shell 402 and has its upper end 406 protruding above the perimetral edge 407 of the upper 404, said shoe being closeable thereat by the skier by means of adapted closure means, preferably a band 408 of the type commercially known by the trade name Velcro.

A first slot 410, essentially C-shaped with the arms 411 directed towards the sole 403,is provided on said shell 402 at the region 409 of the heel of the skier, defining a first small flap 412.

A second slot 414, also essentially C-shaped with the arms 415 directed towards the tip of 416 of the boot 401, is provided on said shell 402 at the region 413 of the instep of the foot.

Said second slot 414 defines a second small flap 417 constituting, together with said first small flap 412, a presser respectively for the regions 413 of the instep of the foot and 409 of the heel.

The shell 402 is furthermore provided on the upper 404 and at the tibial resting region 418 with an essentially V-shaped notch 419, with the apex directed towards the second small flap 417 and affecting said second slot 414.

The upper 404 thus has, at the region 418, two flaps 420, their deformation allowing a gradual flexibility.

A securing and/or adjustment device 422 for at least one traction element is rigidly associated with the region 421 of the back of the upper 404 is constituted by a cable 423 embracing said upper at the tibial resting region 418.

Subsequently said cable 423 is guided, by means of adapted guides 424 and 425 rigidly associated with the shell 402, to embrace the first small flap 412 and then, through a further adapted guide 426, the second small flap 417, to be then rigidly associated at the free end laterally to the shell 402.

In order to adjust the flexibility of the shell 402, a plurality of projecting tabs 427, parallel to one another, equidistant and arranged transversely to the longitudinal axis of the upper, are provided transversely to said flaps 420.

The different positioning of the cable 423 at one of said raised portions allows, during the step of tensioning of said cable, the progressive difficulty of opening of the flaps 420 to thus increase the difficulty of the forward flexing of the leg of the skier.

Flexibility of the boot is thus obtained which is progressively reduced as the cable 423 is placed at the projecting tabs 427 which are further away from the apex of the notch 419.

The ski boot 401 is completed by a covering element 428 constituted by a tubular member in a preferably waterproof, thermally insulating and elasticicized material.

Said covering element is associable with the shell 402, the latter having adapted engagement means such as for example a groove 429 in which the lower perimetral edge 430 of the covering element 428 can be removably fastened.

The covering element 428 naturally also has an opening at the device 422 to allow the actuation thereof by the skier.

The boot provides, besides the upper insertion of the foot, obtainable by widening the upper edge of the shoe and by elastically deformating the covering element 428 of the shell 402, the optimum securing of the foot since the cable 423, during its tensioning, interacts with the first small flap 412 and with the second small flap 417.

Simultaneously with said securing, an adjustment of the flexibility is also obtained by virtue of the presence of the notch 419 and of the projecting tabs 427 provided transversely with respect to the flaps 420.

The boot thus also has an optimum rear support together with a good lateral support.

It has thus been observed that the invention achieves the intended aim and objects, a ski boot having been provided which is obtainable monolithically in plastic material by molding wherein the first slot 410, the second slot 414 and the notch 419 allow its rapid and simple extraction from the mold.

Furthermore, the definition of the first small flap 412 and of the second small flap 417 provides an optimum securing of the foot inside the boot.

The presence of the notch provides, simultaneously with the securing of the foot, also the required adjustment of the degree of flexibility of the boot also by virtue of the presence of the raised portions 427.

Figure 8:
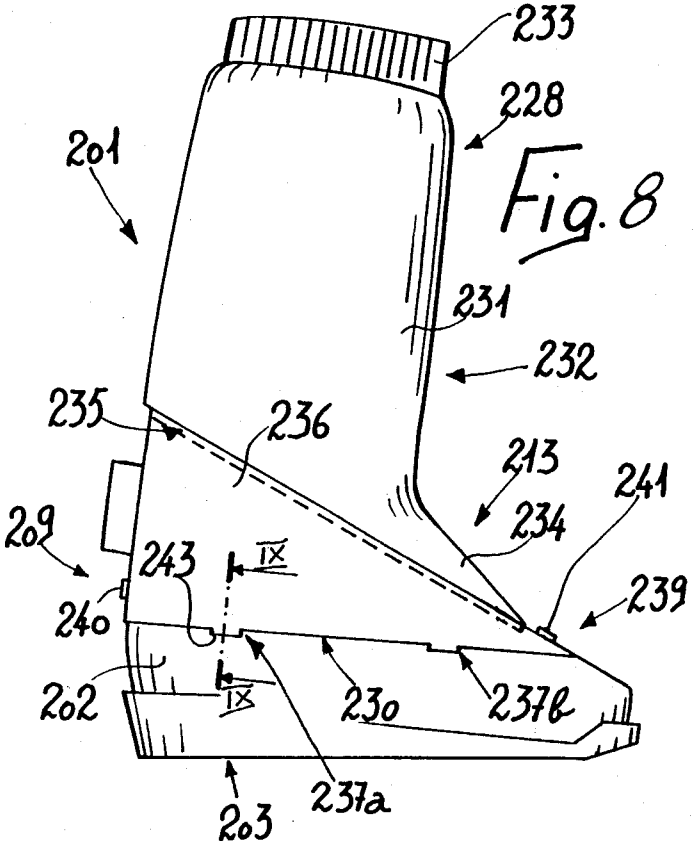
FIG. 8 is a lateral view of a boot according to another aspect of the invention.

FIG. 8 illustrates a boot 201 according to another aspect of the invention, wherein the covering element 228 is constituted by a first soft element 231 embracing the region 232 of the tibia and, partially, the region 213 of the foot instep.

Said first element 231 is provided, at the upper end and at the region 213, with an elasticized portion, respectively indicated by the numerals 233 and 234, to facilitate the insertion and the extraction of the skier's foot.

A second semirigid element 236 is sewn to the perimetral edge 235 of the first element 231 and is provided, at the lower perimetral edge 230 adjacent to the sole 203 and at both sides of the shell 202, with a pair of first teeth **237*a* and 237*b* removably insertable in adapted first eyelets 238 provided on said shell 202**.

The presence on the shell 202, at the regions 209 of the heel and 239 of the metatarsal region, of a pair of second teeth 240 and 241 engaging in adapted second eyelets **242*a* and 242*b* provided on the second element 236, as illustrated respectively in FIGS. 10 and 11, contributes to temporary secure the second element 236 to said shell 202**.

A lug 243, at each of the first teeth **237*a* and 237*b*, protrudes therefrom outside the shell, providing a grip for the skier to facilitate the operation of replacement of the covering element 228**.

Figure 12:
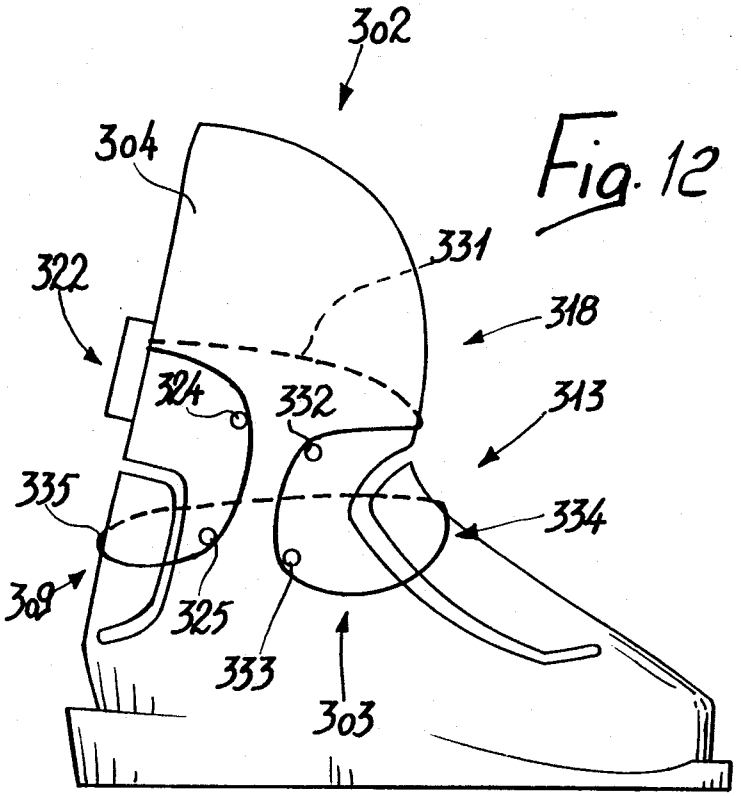
FIG. 12 is a lateral view of a boot according to another aspect of the invention.

The use of a two piece covering element, besides improving the insertability of the boot, also improves the aesthetical characteristics, since the two pieces can be provided with different colors. A different solution related to the lay-out of the cable 303 is illustrated in FIG. 12.

Said cable has a first portion 331 which, starting from the closure device 322 rigidly associated with the upper 304, laterally and frontally embraces said upper at the tibial resting region 318.

Subsequently the cable 303 is returned, by means of the returns 332 and 333 rigidly laterally associated with the shell 302, to define a second portion 334 which embraces the region 313 of the foot instep and a third portion 335 embracing the heel region 309.

The cable is then returned, by means of the returns 324 and 325, to the closure device 322. The materials, as well as the dimensions of the individual components of the ski boot may also be the most suitable according to the specific requirements.

I claim:

1. Ski boot structure comprising a monolithic shell including a substantially rigid sole and an upper, an integral inner shoe of the conventional soft type insertable in said shell, adjustable closure means to adjustably secure said shell to the skier's foot and lower leg, said upper having a top edge and at least one elongate aperture extending downwardly from said top edge, wherein said at least one aperture comprises one first pair of lateral slots proximate to the rear portion of the upper and a second pair of lateral slots proximate to the front portion of the upper, said slots extending longitudinally of said upper to end approximately at the height of the skier's ankle so as to define in said upper at least one rear flap and one front flap which can elastically swivel back and fro and are separated by a pair of lateral portions engaging the skier's malleoli, said closure means being arranged to at least partially embrace said front and rear flaps and said lateral portions of the upper, and wherein said ski boot structure further comprises an at least partially semirigid covering element which is removably associated with said upper to sealingly enclose said upper, whereby operation of said closure means causes width restriction of said slots thus determining substantially uniform and resilient tightening of the ski boot, and whereby said covering element provides both sealing of said slots against snow infiltration and enhanced rigidity of said upper.

2. A ski boot structure according to claim 1, wherein the slots of each pair extend substantially specularly with respect to the vertical longitudinal middle plane of said shell.

3. A ski boot structure according to claim 1, wherein the lower ends of said first pair of slots are adjacent to the heel portion of the skier's foot.

4. A ski boot structure according to claim 1, wherein said second pair of slots have lower ends at least partially affecting the tarsal and metatarsal regions of the skier's foot.

5. A ski boot structure according to claim 1, wherein the slots of said second pair comprise a common upper portion extending along said vertical central longitudinal plane of said shell from the top edge of said upper and further comprise two lower bifurcated portions extending substantially along the instep region of the skier's foot to define said front flap.

6. A ski boot structure according to claim 5, wherein said upper common portion of said second pair of slots defines a vertical notch along said top edge of said upper, said notch separating from each other two front extensions of said lateral upper portions which are located above said front flap and defining a rest portion for the skier's tibia.

7. A ski boot structure according to claim 6, wherein said central vertical notch has inclined edges to define a substantially V-shaped opening with its apex directed towards said front flap and centered on the upper edge thereof.

8. A ski boot structure according to claim 7, further comprising a plurality of substantially parallel and horizontal projecting tabs which are vertically spaced apart, said tabs being formed on the outer surface of said front extensions at both sides of said V-shaped opening.

9. A ski boot structure according to claim 1, wherein said lateral portions of said upper are further bridged above said rear flap to define with said first pair of lateral slots a continuous substantially C-shaped slot having its legs downwardly directed towards said sole.

10. A ski boot structure according to claim 8, wherein said closure means comprises at least a manually operable tensioning device, a flexible traction element having at least one end associated with said tensioning device, and guide means to guide said traction element on said upper.

11. A ski boot structure according to claim 10, wherein said tensioning device is located on said shell at the base of the instep region of the skier's foot.

12. A ski boot structure according to claim 10, wherein said tensioning device is located on said shell proximate to the heel region of the skier's foot.

13. A ski boot according to claim 10, wherein said traction element is a cable having one end fastened to one of said lateral portions of said upper and embracing said front extensions adjacent the tibial resting region to engage one of said plurality of projecting tabs formed thereon, said cable being looped a first time to cooperate with first guide means to thereby embrace said front and said rear flaps and the other of said lateral portions of said upper.

14. A ski boot structure according to claim 3, wherein said traction element is further looped a second time to cooperate with second guide means to thereby embrace said upper proximately to the instep region of the skier's foot.

15. A ski boot structure according to claim 1, wherein said removable covering element is a tubular member formed of a water impermeable, thermally insulating and elasticized material, said tubular member having a lower peripheral edge carrying engagement means removably connectable with complementarily shaped gripping means formed on said shall, said tubular member further having an opening for the passage of said closure means.

16. A ski boot structure according to claim 15, wherein said grip means includes a peripheral groove formed on said shell proximately to said sole thereof.

17. A ski boot structure according to claim 15, wherein said covering element comprises a first tubular portion formed of a substantially soft material and a second tubular portion formed of a substantially semi-rigid material, said upper and said lower portions being firmly joined to each other.

18. A ski boot structure according to claim 17, wherein said first tubular portion embraces both the tibial region and at least partially the instep region of the skier's leg, in these regions the first tubular portion being provided with elasticizes securing bands.

19. A ski boot structure according to claim 17, wherein said second tubular portion has a lower peripheral edge adjacent to said sole, said lower peripheral edge being provided with at least one first pair of teeth removably connectable with a first pair of complementary shaped eyelets provided on said shell.

20. A ski boot structure according to claim 17, wherein a second pair of teeth are formed on said shell proximate the heel and the metatarsal region thereof, said second pair of teeth being removably connectable with a second pair of eyelets provided on said second tubular portion of said covering element.

21. A ski boot structure according to claim 19, wherein said first pair of teeth are further provided with respective lugs facilitating manual gripping thereof.

* * * * *